US006616471B2

(12) United States Patent
Renfro et al.

(10) Patent No.: US 6,616,471 B2
(45) Date of Patent: Sep. 9, 2003

(54) INTEGRATED HORIZONTAL CAM LEVER FOR ZERO-INSERTION FORCE (ZIF) SOCKET ACTUATION

(75) Inventors: Tim A. Renfro, Mesa, AZ (US); Brian C. Kluge, Chandler, AZ (US); Jiteender P. Manik, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/957,535

(22) Filed: Sep. 21, 2001

(65) Prior Publication Data

US 2003/0060074 A1 Mar. 27, 2003

(51) Int. Cl.[7] ..... H01R 4/50
(52) U.S. Cl. ..... 439/342; 439/266
(58) Field of Search ..... 439/263, 266, 439/342, 259–270

(56) References Cited

U.S. PATENT DOCUMENTS 4,402,563 A * 9/1983 Sinclair ..... 439/265
4,624,517 A * 11/1986 Anhalt et al. ..... 439/265
4,950,980 A * 8/1990 Pfaff ..... 439/296
5,057,031 A * 10/1991 Sinclair ..... 439/261
5,256,080 A * 10/1993 Bright ..... 439/342
6,065,990 A * 5/2000 McHugh et al. ..... 439/266
6,179,640 B1 * 1/2001 Sikora et al. ..... 439/342
6,210,199 B1 * 4/2001 Walkup et al. ..... 439/342
6,231,366 B1 * 5/2001 Pei et al. ..... 439/342
6,254,415 B1 * 7/2001 Mizumura et al. ..... 439/342
6,280,223 B1 * 8/2001 Lin ..... 439/342
6,296,506 B1 * 10/2001 Mizumura et al. ..... 439/342
6,338,640 B1 * 1/2002 Lin ..... 439/342
6,464,525 B2 * 10/2002 Mizumura ..... 439/342

* cited by examiner

*Primary Examiner*—P. Austin Bradley
*Assistant Examiner*—Briggitte R. Hammond
(74) *Attorney, Agent, or Firm*—Antonelli, Terry, Stout & Kraus, LLP

(57) ABSTRACT

An advanced zero-insertion force (ZIF) socket for coupling an electronic package having a plurality of electrical pins onto a printed circuit board (PCB) of a computer system. Such a ZIF socket comprises a base having a plurality of receptacles adapted to receive electrical pins of an electronic package; a top plate slidably mounted on the base, having a plurality of pin insertion apertures adapted to permit insertion of the electrical pins of the electronic package; and a cam mechanism having an integrated lever which is operable for actuation in the same plane as the socket, for sliding the top plate over the base in a first direction to permit insertion of the electrical pins of the electronic package into respective apertures of the base, and for sliding the top plate over the base in a second direction opposite to the first direction to secure an electrical coupling of the electrical pins of the electronic package with the receptacles of the base.

18 Claims, 8 Drawing Sheets

610

610

INTEGRATED HORIZONTAL CAM LEVER FOR ZERO-INSERTION FORCE (ZIF) SOCKET ACTUATION

TECHNICAL FIELD

The present invention relates to an electrical socket, and more particularly, relates to an advanced zero-insertion force (ZIF) socket having an integrated horizontal cam lever for securing an electronic package and/or an integrated circuit (IC) chip onto a system board of a computer system.

BACKGROUND

Electrical sockets may be used to secure electronic packages and/or integrated circuit (IC) devices, for example, onto a system board (e.g., a motherboard or a printed circuit board "PCB") of a computer system. These electrical sockets may be constructed for easy installation and replacement of electronic packages (e.g., electrical components) and/or integrated circuit (IC) devices, such as complex memory chips and advanced microprocessor chips. The electrical sockets may also be available in different sizes and configurations, including, for example, low-insertion force (LIF) sockets and zero-insertion force (ZIF) sockets.

Low-insertion force (LIF) sockets may be suitable for detachably securing traditional electronic packages and/or integrated circuit (IC) devices with low pin counts onto a system board of a computer system. However, zero-insertion force (ZIF) sockets are more desirable for advanced electronic packages and/or IC devices which have larger pin counts, since virtually no insertion force and removal force are required. For example, advanced microprocessor chips with high pin counts are typically installed in a zero-insertion force (ZIF) socket which is soldered directly to a system board of a computer system. The ZIF sockets are commonly used to secure advanced microprocessor chips onto a printed circuit board (PCB). This is because the advanced microprocessor chips may be accommodated without fear of damaging the chips or the electrical pins (connections) of the microprocessor chips which provide electrical contacts from the microprocessor chips to the system board.

Typically a ZIF socket may include an actuation lever which, when open, permits easy installation of an electronic package and/or an IC device such as a microprocessor chip into the socket. Subsequent closure of the lever may secure the microprocessor chip in place. A heat sink may be affixed on top of the microprocessor chip or pre-attached to the same microprocessor chip installed in the ZIF socket by mechanical means, such as a retainer clip, for dissipating the heat generated from the microprocessor chip. The heat sink may contain a thermally conductive heat spreader in a form of a flat plate, generally larger than the microprocessor chip, and a plurality of cooling (radiation) fins extending upwardly from the flat plate. A heat sink fan may then be utilized to increase thermal dissipation of the heat sink member and maintain the temperature of the electronic package and/or the IC device at an acceptable level.

However, most commonly available ZIF sockets require a significant overhead room for actuation in the vertical direction to secure an electronic package and/or an IC device onto a system board of a computer system. For those ZIF sockets that make use of common cam technology, special tools such as Allen wrenches carried by assembly personnel are required to actuate or de-actuate the sockets. These special tools also require wide lateral space on the system board for operation, i.e., to actuate and thereby secure the sockets onto the system board or to de-actuate the sockets and thereby release the sockets from the system board of the computer system.

Accordingly, there is a need to provide an advanced ZIF socket having an integrated cam lever for actuation/de-actuation without the use of an external tool and without the requirement of overhead room for operation.

BRIEF DESCRIPTION OF THE DRAWINGS

A more complete appreciation of exemplary embodiments of the present invention, and many of the attendant advantages of the present invention, will become readily apparent as the same becomes better understood by reference to the following detailed description when considered in conjunction with the accompanying drawings in which like reference symbols indicate the same or similar components, wherein.

DETAILED DESCRIPTION

The present invention is applicable for use with all types of sockets and heat sinks, and all electronic packages and IC devices, including new microprocessor chips which may become available as computer technology develops in the future. Further, the present invention is not limited to use in computer systems, but is suitable for applications in many industries and/or environments such as automotive, telecommunications, etc. However, for the sake of simplicity, discussions will concentrate mainly on exemplary use of a zero-insertion force (ZIF) socket onto a system board of a computer system, although the scope of the present invention is not limited thereto.

Figure 1:
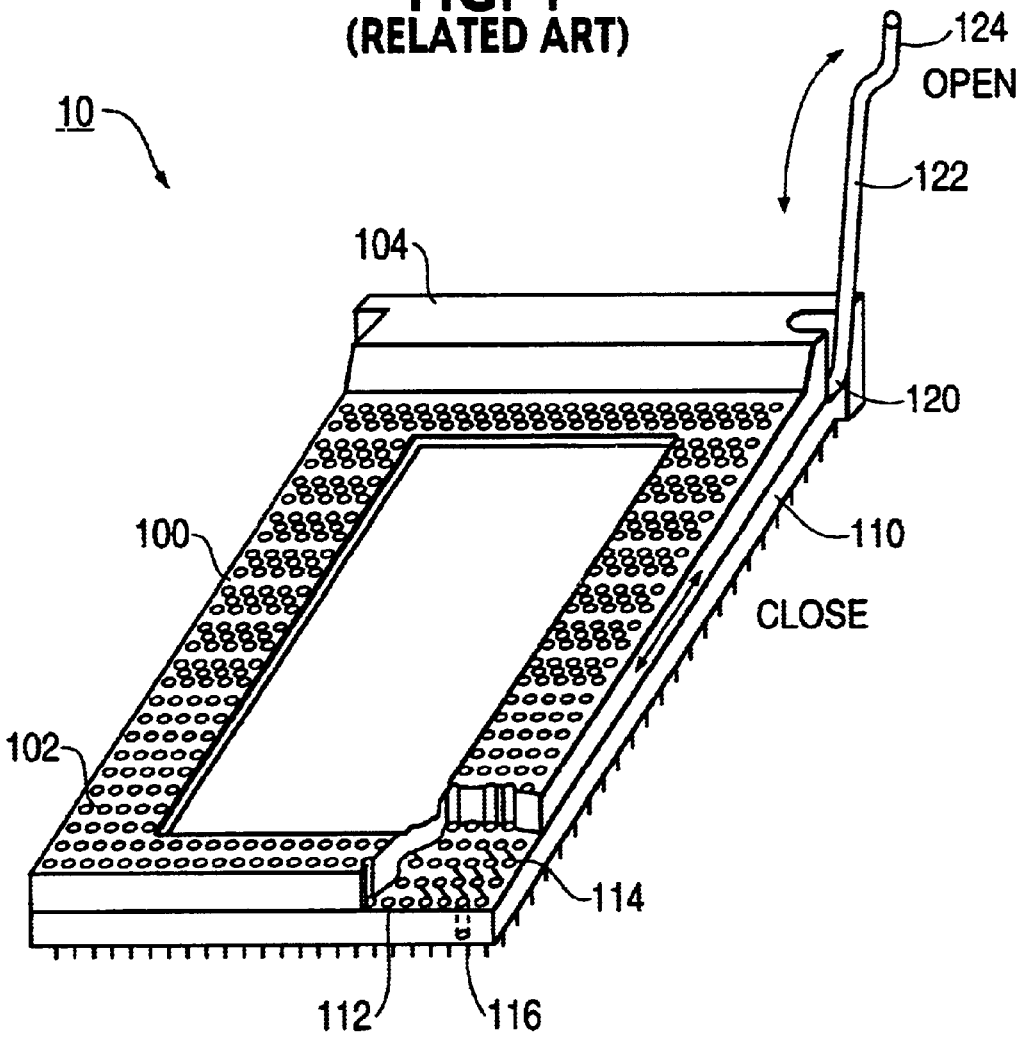
FIG. 1 (RELATED ART)
FIG. 1 illustrates a perspective view of an example zero-insertion force (ZIF) socket.

Attention now is directed to the drawings and particularly to FIG. 1, an example of a commonly available zero-insertion force (ZIF) socket 10 used to secure an electronic package such as a microprocessor chip onto a system board of a computer system is illustrated. As shown in FIG. 1, the ZIF socket 10 may include a top plate (cover) 100, a base 110, and a cam mechanism 120. The top plate 100 and the base 110 may be made from dielectric materials such as plastics, ceramics and other insulators, and can be varied in sizes, shapes and openings to secure different types of electronic packages and/or IC devices onto a system board of a computer system as desired. The top plate 100 may be slidably mounted on the base 110, and may be movable over a top surface of the base 110 between an open position and a closed position in response to movement of the cam mechanism 120.

The top plate 100 of an example zero-insertion force (ZIF) socket 10 may contain a plurality of pin insertion apertures 102 for accepting electrical pins from an electronic package such as a microprocessor chip. The base 110 of the example ZIF socket 10 may contain a corresponding plurality of openings (receptacles) 112, housing spring elements (contacts) 114, each of which has a tail portion 116. The tail portions 116 may protrude through a plurality of corresponding openings formed in the system board (not shown), and may be soldered, for example, to the system board circuitry of a computer system.

When the top plate 100 is in an open position, that is, when the top plate 100 moves in a first direction (i.e., an upward direction) toward an open position, the electrical pins (e.g., connections) of an electronic package such as a microprocessor chip may be freely inserted through the aperture 102 in the top plate 100 and into their respective openings (receptacles) 112 in the base 110 and the spring elements (contacts) 114. When the top plate 100 is in a closed position, that is, when the top plate 100 moves in a second, opposite direction (i.e., a downward direction) toward a closed position, the electrical pins of an electronic package may be engaged physically (e.g., pinched) and electrically with the respective spring elements (contacts) 114 of the base 110. Conversely, when the top plate 100 moves again back toward an open position, the pins of an electronic package may be physically disengaged from the respective spring elements (contacts) 114 of the base 110 for easy removal of the electronic package from the ZIF socket 10.

The cam mechanism 120 provides a means for sliding the top plate 100 over the base 110 between the open and closed positions. The cam mechanism 120 may be mounted in a tunnel between the top plate 100 and the base 110, and may be located inside a raised portion 104 of the top plate 100. The cam mechanism 120 may include a lever 122 which is transversely connected to rotate the camshaft in vertical (first and second) directions, causing the top plate 100 to translate relative to the base 110. The lever 122 may contain an end portion 124 which is bent at an angle of approximately 15°–45° from the axis of the lever 122. The bent end 124 of the lever 122 may allow for the lever 122 to be easily grasped for rotation in the vertical directions to translate the top plate 100 over the base 110 between open and closed positions.

Figure 2:
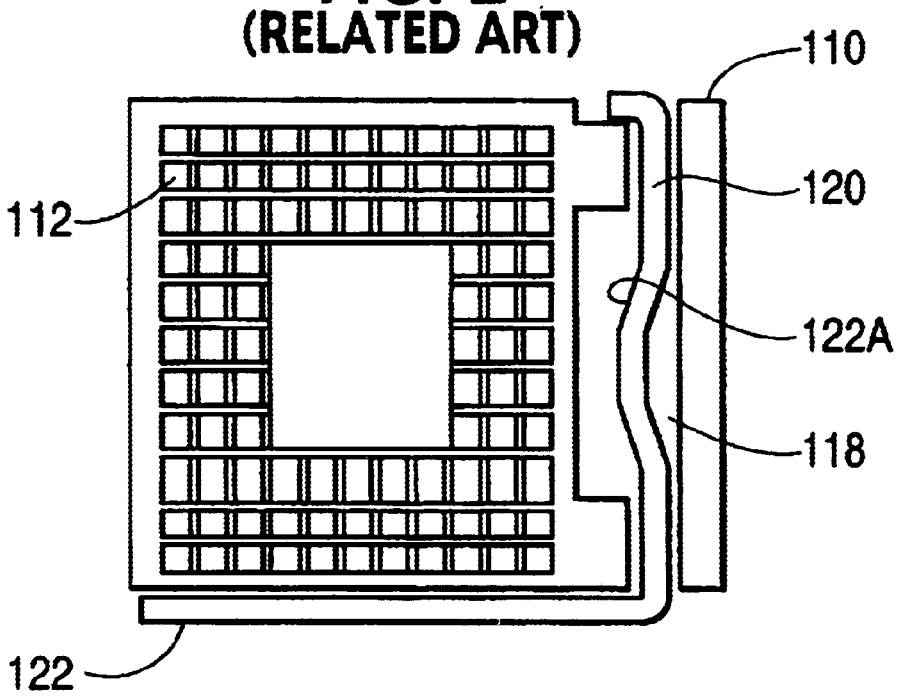
FIG. 2 (RELATED ART)
FIG. 2 illustrates a top view of an example zero-insertion force (ZIF) socket with a lever rotated to a closed position.

FIG. 2 illustrates a top view of an example zero-insertion force (ZIF) socket with a lever rotated to a closed position. As shown in FIG. 2, the base 110 (disassembled from the top plate (100) of the zero-insertion force (ZIF) socket 10 may include a channel 118 with a T-shaped plan for holding the cam mechanism 120. The cam mechanism 120 may correspond to a rod having a circular cross-section with a cam or a jog 122A providing an eccentricity that can deliver an inward thrust for purposes of translating the top plate 100 over the base 110, when the lever 122 of the cam mechanism 120 is rotated in a predetermined direction (e.g., upward or downward direction). Alongside the channel 118 may be an array of pin insertion apertures 112 designed to accommodate springs 114 and/or the electrical pins from an electronic package such as a microprocessor chip.

Figure 3:
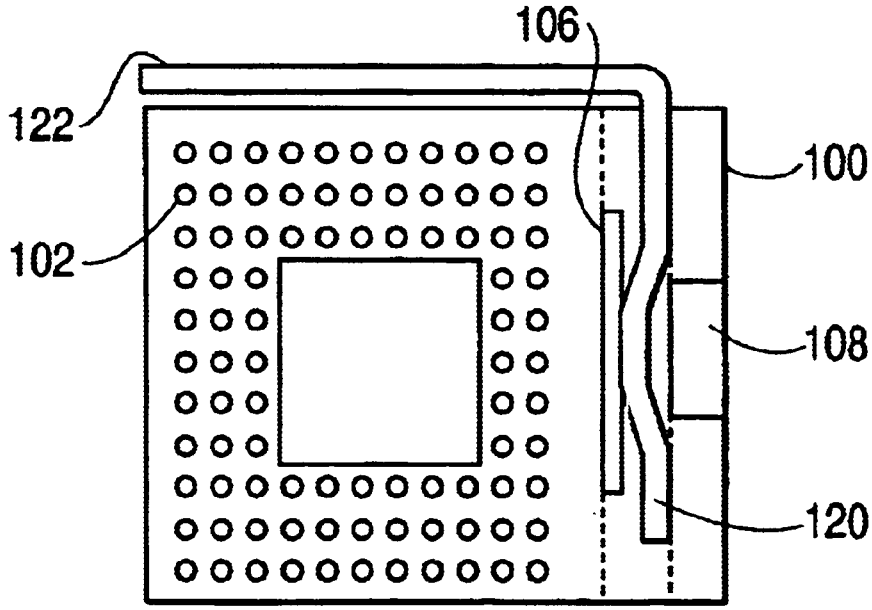
FIG. 3 (RELATED ART)
FIG. 3 illustrates a corresponding bottom view of an example zero-insertion force (ZIF) socket with a lever rotated to a closed position.

In FIG. 3, the cam mechanism 120 of the zero-insertion force (ZIF) socket 10 is shown positioned against the underside of top plate 100 (disassembled from the base 110) with the cam or jog 122A transmitting camming force to retaining posts 106 and 108 so as to generate a force necessary to translate the top plate 100 over the base 110, when the lever 122 of the cam mechanism 120 is rotated in the predetermined direction (e.g., upward or downward direction) between open and closed positions.

Figure 4:
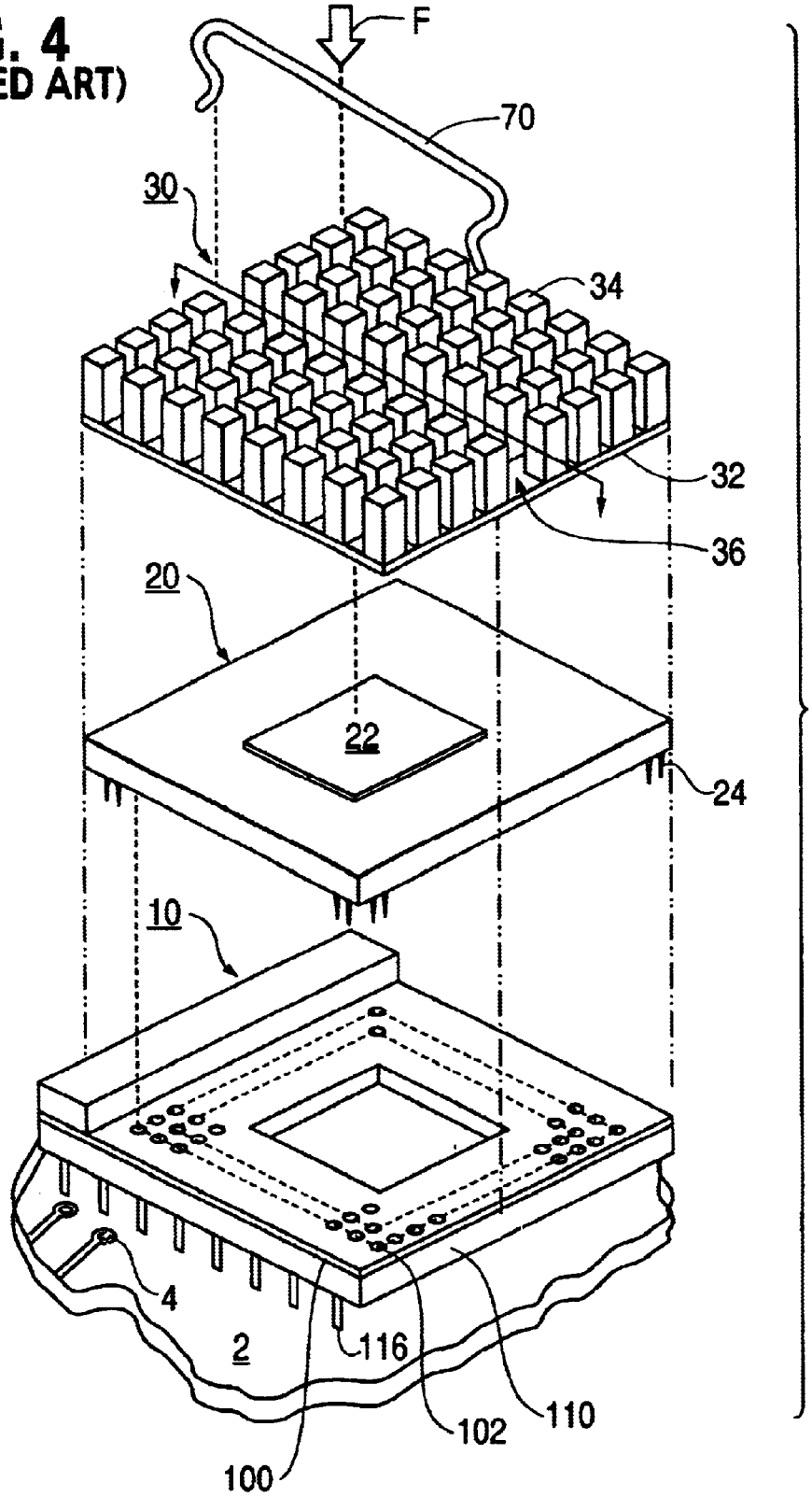
FIG. 4 (RELATED ART)
FIG. 4 illustrates a perspective view of an example zero-insertion force (ZIF) socket used for securing an electronic package and a heat sink.

FIG. 4 illustrates an example of a zero-insertion force (ZIF) socket used for securing an electronic package onto a system board 2 of a computer system. Such a system board 2 may be a commonly used board, known as a printed circuit board or a mother board, and may contain a plurality of through-holes 4 for solder mounting of the ZIF socket for easy installation and replacement of electronic packages and/or IC devices from the system board 2. The ZIF socket 10 may include a top plate 100, a base 110 and a cam mechanism 120 assembled and ready for supporting an electronic package 20 and a heat sink 30.

The electronic package may be in a form of a substrate 20 having an open die microprocessor chip 22 disposed thereon. The heat sink 30 may contain a plate 32 with a flat bottom surface. The flat plate 32 may generally be rectangular and its size may be co-extensive with the size of the electronic package 20. The heat sink 30 may contain a large number of cooling (radiation) fins 34 extending or projecting upwardly from the flat plate 32. Usually, the heat sink 30 may also include a channel 36 in a central region extending across the flat plate 32 for purposes of accommodating a separate retainer clip 70 to secure the heat sink 30 and the electronic package 20 onto the ZIF socket 10, via protrusions 106 projecting laterally from a side wall of the ZIF socket 10. A thermal interface material may be disposed between the heat sink 30 and the substrate 20 containing an open die microprocessor chip 22 so as to facilitate thermal coupling and transfer. The thermal interface material may be metallic film, thermal grease, or the like.

As shown in FIG. 4, the substrate 20 having an open die microprocessor chip 22 disposed thereon must be properly installed on the ZIF socket 10. Optionally, position pins 24 of the substrate 20 and corresponding apertures 102 of the ZIF socket 10 may be utilized to retain the substrate 20 relative to the ZIF socket 10. Next, the heat sink 30 must then be separately aligned properly with the ZIF socket 10 and placed squarely on top of an open die microprocessor chip 22 in order to prevent damage to the open die microprocessor chip 22 and ensure correct microprocessor operation. A clip 70 may also be used to secure the heat sink 30 in place relative to the ZIF socket 10.

As described with reference to FIGS. 1–4, most commonly available ZIF sockets require a significant overhead room for the lever 122 of a cam mechanism 120 to actuate and de-actuate in the vertical direction (i.e., upward or downward direction) so as to secure an electronic package and/or an IC device onto a system board 2. The problems arise when the system board 2 as installed in the computer system lacks overhead room for actuation.

Figure 5A:
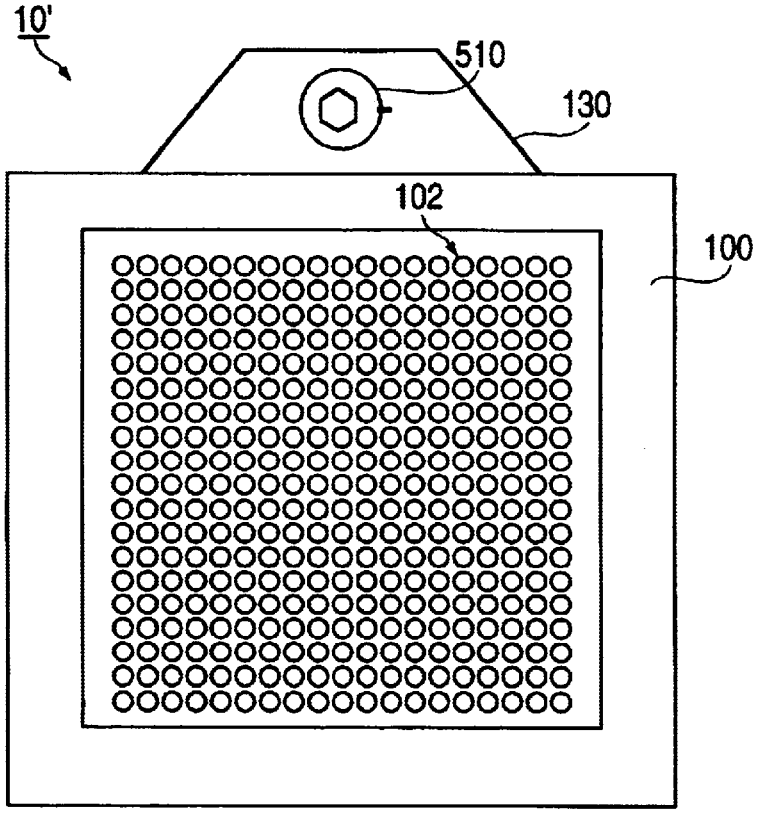
FIG. 5A (RELATED ART)
FIGS. 5A–5B illustrate top and side views of another example zero-insertion force (ZIF) socket.
Figure 5B:
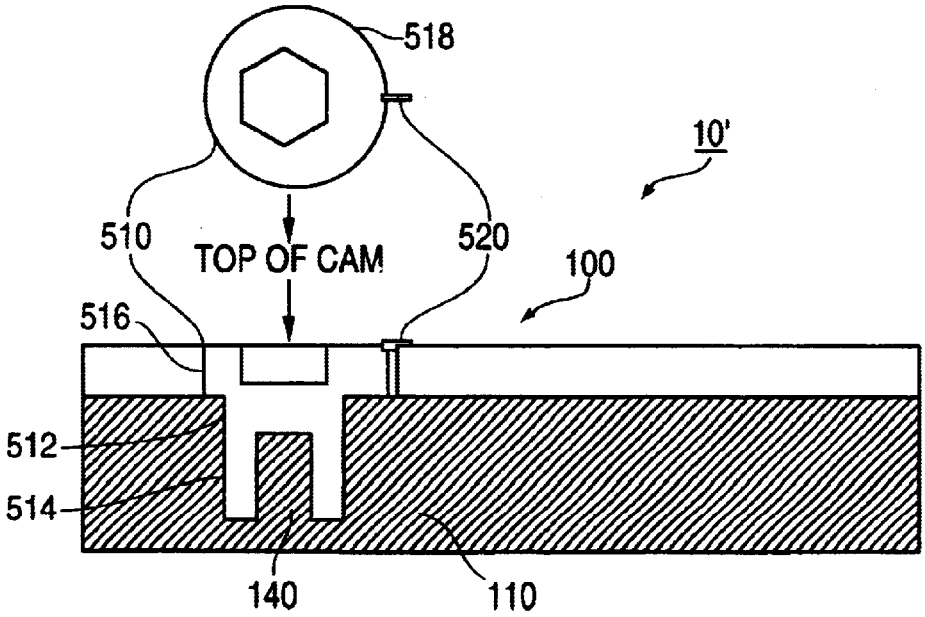
FIG. 5B (RELATED ART)

FIGS. 5A–5B illustrate an example of another commonly available ZIF socket 10' used to secure an electronic package such as a microprocessor chip onto a system board of a computer system is illustrated. As shown in FIG. 5A, the ZIF socket 10' may include the same top plate (cover) 100 and the base 110, but a different type of cam mechanism, i.e., a rotary cam 510. In this embodiment, the base 110 of the ZIF socket 10' contains a base cam post 140 arranged at an extended support portion 130 to receive the rotary cam 510. The rotary cam 510 includes, as shown in FIG. 5B, a camshaft 512, protrusions 514 extended therefrom to position into the base cam post 140 of the base 110, and a head portion 516 including a hex opening 518 at a head surface to allow a special tool such as an Allen wrench to rotate the rotary cam 510 for enabling the top plate 100 to slide over a top surface of the base 110 between an open position and a closed position. A stopper 520 may be extended from the head portion 516 of the rotary cam 510 to prevent the rotary cam 510 from over rotation.

Again, when the rotary cam 510 is rotated by an external tool such as an Allen wrench in a first direction (i.e., clockwise direction), the top plate 100 is forced to slide to an open position. As a result, the electrical pins (e.g., connections) of an electronic package such as a microprocessor chip may be freely inserted through the aperture 102 in the top plate 100 and into their respective openings (receptacles) 112 in the base 110 and the spring elements (contacts) 114. Similarly, when the rotary cam 510 is rotated by the Allen wrench in a second, opposite direction (i.e., counterclockwise direction) to slide the top plate 100 to a closed position, the electrical pins of an electronic package may be engaged physically (e.g., pinched) and electrically with the respective spring elements (contacts) 114 of the base 110. Likewise, when the top plate 100 moves again back toward an open position, the pins of an electronic package may be physically disengaged from the respective spring elements (contacts) 114 of the base 110 for easy removal of the electronic package from the ZIF socket 10'.

For those ZIF sockets that make use of common cam technology as described with reference to FIGS. 5A–5B, special tools carried by assembly personnel are required to actuate or de-actuate the sockets. These special tools also require wide lateral space on the system board 2 for operation, i.e., to actuate and thereby secure the sockets onto the system board 2 or to deactuate the sockets and thereby release the sockets from the system board 2 of the computer system.

Figure 6A:
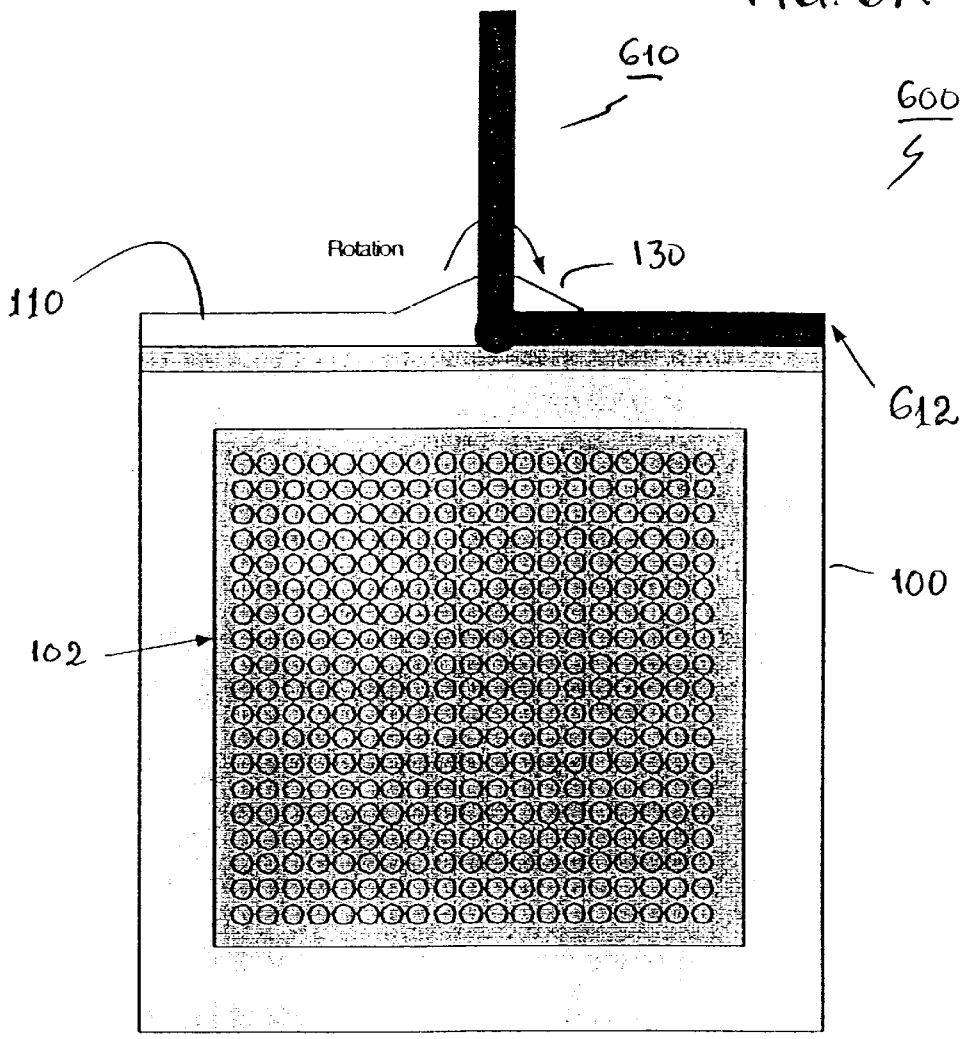
FIGS. 6A–6B illustrate an advanced zero-insertion force (ZIF) socket having a horizontal cam mechanism with an integrated cam lever for actuation according to an embodiment of the present invention.
Figure 6B:
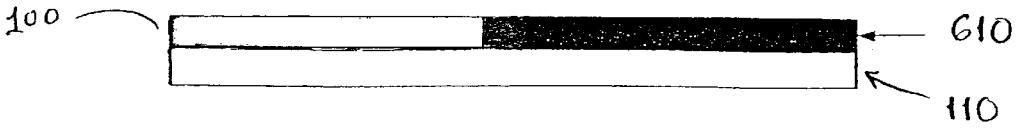

Turning now to FIGS. 6A–6B, an advanced ZIF socket 600 having a horizontal cam mechanism 610 for actuation according to an embodiment of the present invention is illustrated. The horizontal cam mechanism 610 may be pivotally fixed to the base 110 for actuating or deactuating in a lateral direction (e.g., clockwise or counterclockwise direction) to enable the top plate 100 to slide over the top surface of the base 110 between an open position and a closed position in order to eliminate the requirement of overhead room for actuation as described with reference to FIGS. 1–4 and the use of an external tool such as an Allen wrench as described with reference to FIGS. 5A–5B.

As shown in FIG. 6A, the horizontal cam mechanism 610 includes an integrated cam lever 612 extending therefrom for enabling a user to rotate in a lateral direction (e.g., clockwise or counterclockwise direction) between an open position and a closed position. Depending upon implementations, the cam lever 612 may be rotated at a predetermined angle, for example, a 90° angle or a 180° angle between an open position and a closed position. When rotated to a closed position, the cam lever 612 of the horizontal cam mechanism 610 may be inset into the ZIF socket 600 as shown in FIG. 6B.

Figure 7A:
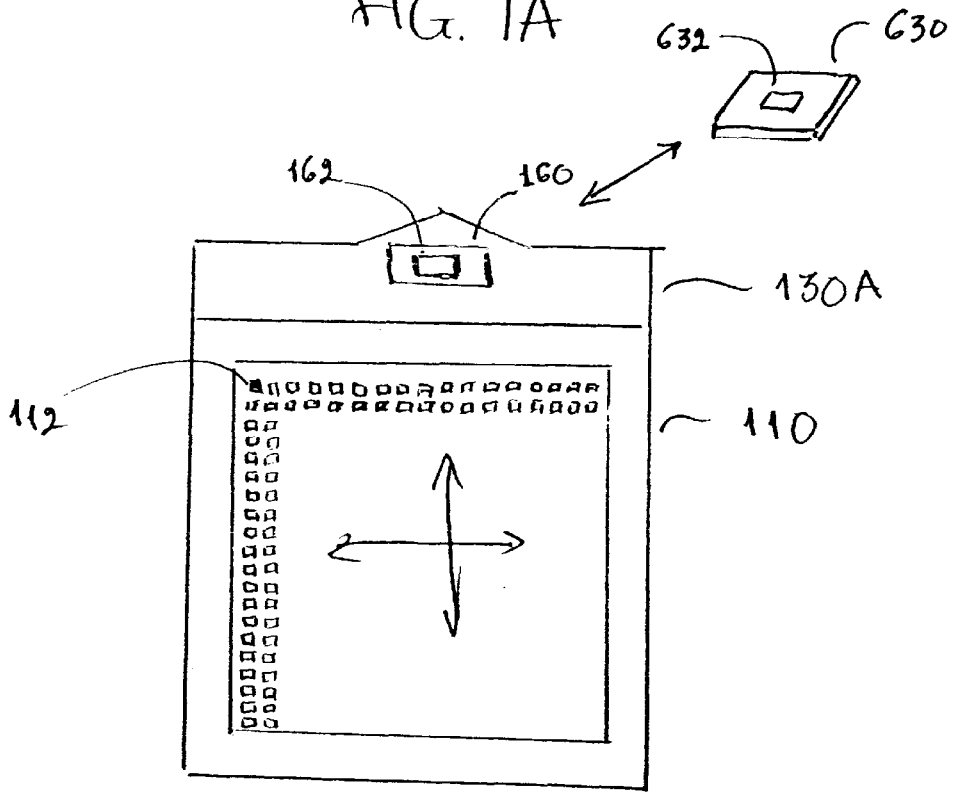
FIGS. 7A–7B illustrate top and corresponding bottom views of an example advanced zero-insertion force (ZIF) socket having a horizontal cam mechanism according to an embodiment of the present invention.
Figure 7B:
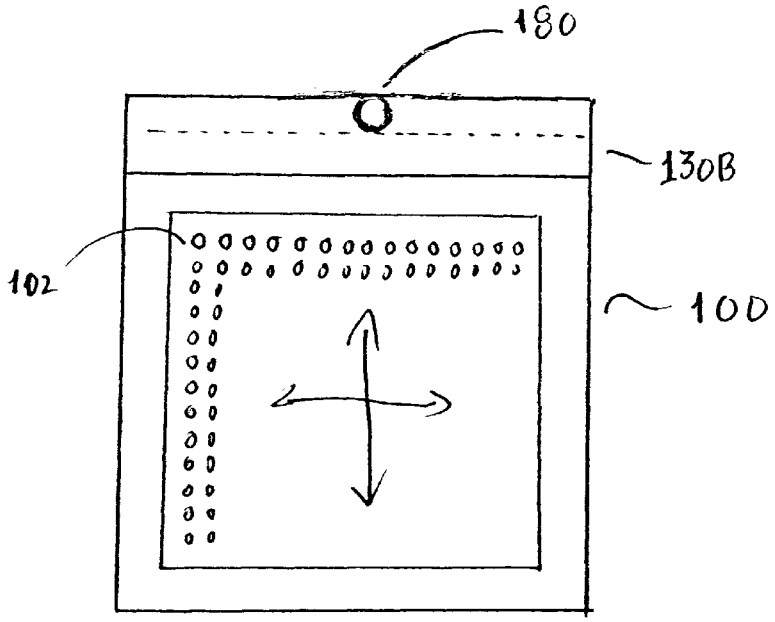

FIGS. 7A–7B illustrate top and bottom views of an example advanced zero-insertion force (ZIF) socket 600 according to an embodiment of the present invention. Specifically, FIG. 7A shows the base 110 (disassembled from the top plate 100) including a cam portion 130A and an array of openings (receptacles)112 designed to accommodate springs 114 and/or the electrical pins from an electronic package such as a microprocessor chip. The cam portion 130A of the base 110 contains a rectangular recess 160 including therein a substantially rectangular opening (slot) 162 perforated through the base 110 in order to accommodate a flat-face cam follower 630. The cam follower 630 includes therein a corresponding opening (slot) 632 perforated through the follower 630. When assembled with the top plate 100, the cam follower 630 may be fixedly positioned inside the rectangular recess 160 with its opening (slot) 632 aligned with the opening (slot) 162 of the rectangular recess 160.

FIG. 7B shows the top plate 100 (disassembled from the base 110) including a corresponding cam portion 130B and an array of pin insertion apertures 102 designed to accept electrical pins from an electronic package such as a microprocessor chip. The cam portion 130B of the top plate 100 contains a circular hole 180 perforated through the top plate 100.

Figure 8A:
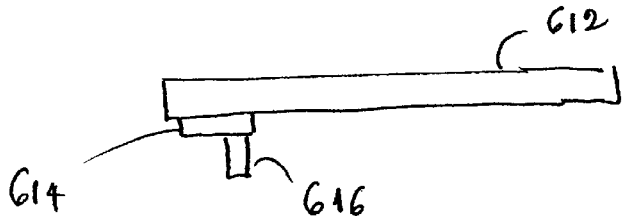
FIGS. 8A–8B illustrate a perspective view of a horizontal cam mechanism with an integrated cam lever according to an embodiment of the present invention.
Figure 8B:
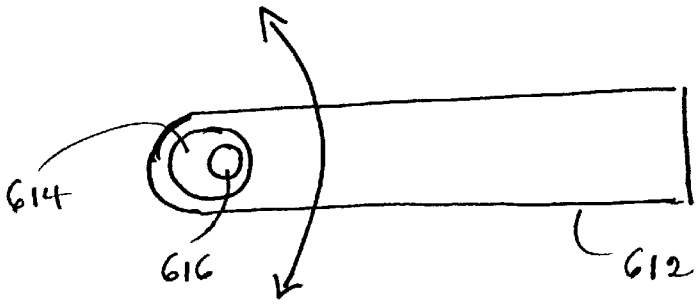

FIGS. 8A–8B illustrate a perspective view of a horizontal cam mechanism 610 with an integrated cam lever 612 according to an embodiment of the present invention. As shown in FIG. 8A, the horizontal cam mechanism 610 may include a circular cam shaft 614 located at a distal end of the integrated cam lever 612 and an eccentric cam (protrusion) 616 extending therefrom for insertion, via the circular hole 180 of the top plate 100, the opening 632 of the cam follower 630 and the corresponding opening 162 of the base 110. In one embodiment of the present invention, the cam shaft 614 may include a diameter substantially the same as that of the hole 180 of the top plate 100 and a thickness substantially the same as that of the top plate 100. Therefore, when the cam shaft 614 of the horizontal cam mechanism 610 is inserted through the opening 180 of the top plate 100, only the eccentric cam (protrusion) 616 may be extended through the opening 632 of the cam follower 630 and the corresponding opening 162 of the base 110. Separately, a secure flange (not shown) may be used to secure the horizontal cam mechanism 610 in place when the cam shaft 614 is inserted through the opening 180 of the top plate 100, and the eccentric cam (protrusion) 616 is extended through the opening 632 of the cam follower 630 and the corresponding opening 162 of the base 110.

As shown in FIG. 8B, when the integrated cam lever 612 of the horizontal cam mechanism 610 is rotated on the same plane as the ZIF socket 600 (i.e., a clockwise or counterclockwise direction), the eccentric cam (protrusion) 616 may be rotated about a center of the cam shaft 614 of the horizontal cam mechanism 610. For example, when the integrated cam lever 612 of the horizontal cam mechanism 610 is rotated in a counterclockwise direction at a predetermined angle, for example, a 90° angle, the eccentric cam (protrusion) 616 may rotate in the same direction with the cam shaft 614 and thereby pushing the top plate 100, via the cam follower 630, to slide over the top surface of the base 110 towards an open position. Likewise, when the integrated cam lever 612 of the horizontal cam mechanism 610 is rotated in an opposite, clockwise direction, the eccentric cam (protrusion) 616 may rotate in the same direction with the cam shaft 614 and thereby pushing the top plate 100, via the cam follower 630, to slide over the top surface of the base 110 back towards a closed position. The horizontal cam mechanism 610 as shown in FIGS. 8A–8B may be made of steel, often hardened to resist wear and, for high-speed application, precisely ground. In addition, the cam lever 612 may contain an end handle (not shown) for easy cam rotation in a horizontal direction to translate the top plate 100 over the base 110 between open and closed positions.

Figure 9:
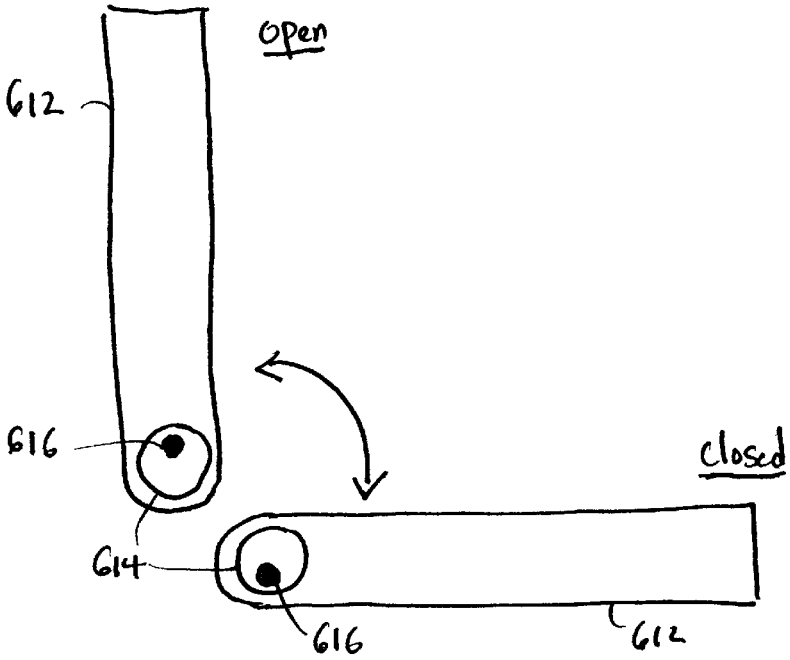
FIG. 9 illustrates a bottom view of a horizontal cam mechanism with an integrated cam lever rotatable at a predetermined angle of cam rotation between an open position and a closed position according to an example embodiment of the present invention.

FIG. 9 illustrates a bottom view of a horizontal cam mechanism 610 with an integrated cam lever 612 rotatable at a predetermined angle, for example, at a 90° angle of cam rotation between an open position and a closed position according to an example embodiment of the present invention. As shown in FIG. 9, the cam lever 612 of the horizontal cam mechanism 610 may be rotated at a 90° angle of cam rotation between an open position and a closed position. When rotated to one known position, for example, a closed position, the cam lever 612 of the horizontal cam mechanism 610 may be inset into the ZIF socket 600 as shown in FIG. 6B. The eccentric cam (protrusion) 616 extending from the cam shaft 614 of the horizontal cam mechanism 610 may remain at a bottom end of the cam shaft 614. When rotated to an opposite, or open position, the cam lever 612 of the horizontal cam mechanism 610 may be extended at 90° angle from the closed position. The eccentric cam (protrusion) 616 extending from the cam shaft 614 of the horizontal cam mechanism 610 may be rotated to a top end of the cam shaft 614 providing an eccentricity that can deliver an inward thrust for purposes of translating the top plate 100 over the base 110.

Figure 10:
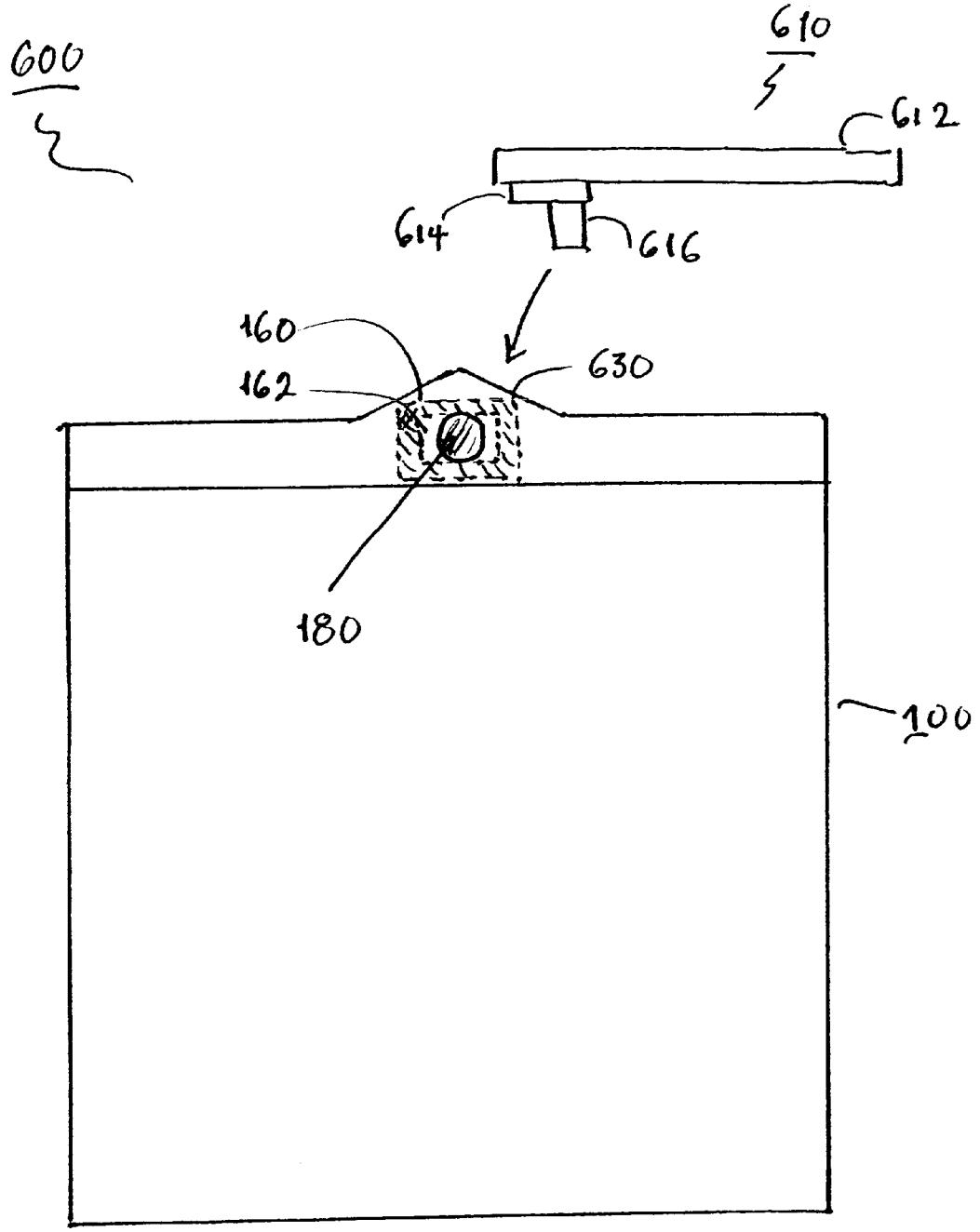
FIG. 10 illustrates a perspective view of an example advanced zero-insertion force (ZIF) socket having a horizontal cam mechanism with an integrated cam lever rotatable in a horizontal (lateral) direction to secure an electronic package according to an embodiment of the present invention.

FIG. 10 illustrates a perspective view of an example advanced zero-insertion force (ZIF) socket 600 having a horizontal cam mechanism 610 with an integrated cam lever 612 rotatable in a horizontal direction (on the same plane as the socket 600) to secure an electronic package according to an embodiment of the present invention. As shown in FIG. 10, the top plate 100 may be mounted on the base 110 having the cam follower 630 fixedly positioned in the recess 160 of the base 110. The horizontal cam mechanism 610 may then be attached onto the ZIF socket 600 for cam rotation between an open position and a closed position. Specifically, the cam shaft 614 of the horizontal cam mechanism 610 may be fixedly positioned in the hole 180 of the top plate 100, and the eccentric cam 616 may be extended through the opening 632 of the cam follower 630 and the corresponding opening 162 of the base 110. In addition, a secure flange (not shown) may be used to secure the eccentric cam 616 when the eccentric cam (protrusion) 616 is extended through the opening 632 of the cam follower 630 and the corresponding opening 162 of the base 110.

The ZIF socket 600 as described with reference to FIGS. 6–10 may be fabricated using standard socket creation process. For example, the top plate 100 including a hole 180 and an array of pin insertion apertures 102, and the base 110 including a recess 160 and an array of receptacles 112 may be molded, via plastic molding. Similarly, the horizontal cam mechanism 610 including an integrated cam lever 612, a cam shaft 614 at a distal end of the integrated cam lever 612 and an eccentric cam 616 may also be molded, via steel molding. Spring elements (contacts) may be formed separately and inserted into the receptacles 112 of the base 110. The cam follower 630 may then be positioned into the recess 160 of the base 110. The top plate 100 may then be mounted on the base 110. Lastly, the horizontal cam mechanism 610 may be attached to the ZIF socket 600.

As described from the foregoing, the advanced zero-insertion force (ZIF) socket including a horizontal cam mechanism according to the present invention is advantageously provided to enable lever actuation in the same plane as the socket in order to eliminate the use of external tools and the requirement of an overhead room. As a result, no external tool is required. Likewise, less operation space is obtained in comparison with commonly available sockets using vertically rotatable actuation levers.

While there have been illustrated and described what are considered to be exemplary embodiments of the present invention, it will be understood by those skilled in the art and as technology develops that various changes and modifications may be made, and equivalents may be substituted for elements thereof without departing from the true scope of the present invention. For example, the electrical contacts of the pin insertion apertures may be available in a variety of size and shapes with different projections. The horizontal cam mechanism may include different driving elements such as worm gears, wedges, ratchets, etc. Moreover, the camshaft of the cam mechanism may be located at a distal end of the cam portion as opposed to a center of the horizontal cam portion as described with reference to FIGS. 6–10. Such a camshaft of the horizontal cam mechanism may also be positioned at various angles and may work with different sized and/or shaped lever. The overall dimensions of the ZIF socket may be altered depending upon the electrical elements used, the desired strength, the structural rigidity, and the thermal stability. In addition, different sizes and shapes of the integrated lever may be alternatively used in lieu of the lever shown as long as the lever may serve to actuate the top plate of the ZIF socket to lock the pins (electrical contacts) of an electronic package in an electrical engagement with the respective spring elements (sockets) of the base of the ZIF socket in the same plane as the socket (in the horizontal direction). In addition, the cam lever may be configured to rotate at a different angle, for example, a 45° or a 180° angle of cam rotation between a closed position and an open position to secure an electronic package. Many modifications may be made to adapt the teachings of the present invention to a particular situation without departing from the scope thereof. Therefore, it is intended that the present invention not be limited to the various exemplary embodiments disclosed, but that the present invention includes all embodiments falling within the scope of the appended claims.

What is claimed is:

1. A socket for coupling an electronic package onto a system board, comprising:

a base having a plurality of receptacles to receive electrical connections of an electronic package;

a top plate mounted on the base, having a plurality of pin insertion apertures to permit insertion of the electrical connections of said electronic package; and a cam mechanism operable to rotate laterally along a translation direction of the socket so as to permit insertion of the electrical connections of said electronic package into respective apertures of the base, and to secure an electrical coupling of the electrical connections of said electronic package with the receptacles of the base, wherein said cam mechanism comprises:

a lever;

a cam shaft located at, and extended from a distal end of the lever; and an eccentric cam extended from the cam shaft for insertion, via an opening of the base and the top plate and a cam follower secured between the base and the top plate, for enabling the lever to rotate about the cam shaft laterally along the translation direction of the socket guided by the cam follower.

2. The socket as claimed in claim 1, wherein said electronic package is a substrate supporting a microprocessor chip.

3. The socket as claimed in claim 1, wherein the cam mechanism is operable for translating the top plate over the base in a first direction to permit insertion of the electrical connections of said electronic package into respective apertures of the base, and for translating the top plate over the base in a second, opposite direction to secure said electrical coupling of the electrical connections of said electronic package with the receptacles of the base.

4. The socket as claimed in claim 3, wherein the lever of said cam mechanism is configured to rotate away from the top plate of the socket and along the translation direction of the socket in the first and second directions.

5. The socket as claimed in claim 3, wherein: the base further includes a cam portion having a rectangular recess and a substantially rectangular opening perforated through the base to accommodate the cam follower;

the top plate further includes a cam portion having a circular hole perforated through the top plate; and the eccentric cam extends from the cam shaft for insertion, via the circular hole of the top plate, an opening of the cam follower and the corresponding opening of the base.

6. The socket as claimed in claim 5, wherein said cam shaft exhibits a diameter substantially the same as that of the hole of the top plate and a thickness substantially the same as that of the top plate.

7. The socket as claimed in claim 5, wherein, when the lever is rotated laterally along the translation direction of the socket, the eccentric cam is rotated about center of the cam shaft of said cam mechanism and thereby pushing the top plate, via the cam follower, to slide over the base between open and closed positions.

8. The socket as claimed in claim 5, wherein said integrated lever is adapted to rotate at a 90° angle of cam rotation providing an eccentricity that can deliver an inward thrust for purposes of translating the top plate over the base between open and closed positions.

9. A socket for coupling an electronic package having selected openings and a plurality of electrical connections, comprising:

a base having a plurality of receptacles adapted to receive electrical connections of an electronic package, and substantially rectangular recess and an opening therein perforated through the base accommodating flat-face cam follower;

a top plate slidably mounted on the base, having a plurality of pin insertion apertures adapted to permit insertion of the electrical connections of said electronic package; and a cam mechanism having an integrated lever operable for actuation along a lateral direction of the socket, for sliding the top plate over the base between an open position and a closed position to permit insertion of the electrical connections of said electronic package into respective apertures of the base, and to secure an electrical coupling of the electrical connections of said electronic package with the receptacles of the base, wherein said cam mechanism comprises:

is a cam shaft located at a distal end of the integrated lever;

an eccentric cam extended from the cam shaft for insertion, via an opening of the flat-face cam follower and the corresponding opening of the base; and the integrated lever transversely connected for rotating about the camshaft along the lateral direction of the socket, causing the top plate to slide over the base between an open position and a closed position.

10. The socket as claimed in claim 9, wherein said electronic package is a substrate a microprocessor chip.

11. The socket as claimed in claim 9, wherein:

the base further includes a cam portion having the rectangular recess and the opening perforated through the base to accommodate the flat-face cam follower;

the top plate further includes a cam portion having a circular hole perforated through the top plate; and the eccentric cam extension from the cam shaft for insertion, via the circular hole of the top plate, the opening of the flat-face cam follower and the corresponding opening of the base.

12. The socket as claimed in claim 11, wherein said cam shaft exhibits a diameter substantially the same as that of the hole of the top plate and a thickness substantially the same as that of the top plate.

13. The socket as claimed in claim 11, wherein, when the integrated lever is rotated along the lateral direction of the socket, the eccentric cam is rotated about a center of the cam shaft thereby pushing the top plate, via the cam follower, to slide over the base between open and closed positions.

14. The socket as claimed in claim 11, wherein said integrated lever is adapted to rotate at a 90° angle of cam rotation providing an eccentricity that can deliver an inward thrust for purposes of translating the top plate over the base between open and closed positions.

15. A socket for coupling an electronic package comprising:

a base including a cam portion and an array of receptacles adapted to receive electrical connections of an electronic package, wherein the cam portion of the base includes a recess and an opening perforated through the base to accommodating a cam follower;

a top plate slidably mounted on the base, including a cam portion and an array of pin insertion apertures adapted to permit insertion of the electrical connections of said electronic package, wherein the cam portion of the top plate includes a hole perforated through the top plate; and a cam mechanism operable for sliding the top plate over the base between an open position and a closed position, the cam mechanism comprising:

an integrated lever;

a cam shaft located at a distal end of the integrated lever and inserted; and an eccentric cam extended from the cam shaft for insertion, via the hole of the top plate, the opening of the cam follower and the corresponding opening of the base;

wherein the integrated lever is transversely connected to rotate about the camshaft along a lateral direction of the socket, causing the eccentric cam to move the top plate to slice over the base between open and closed positions.

16. The socket as claimed in claim 15, wherein said cam shaft exhibits a diameter substantially the same as that of the hole of the top plate and a thickness substantially the same as that of the top plate.

17. The socket as claimed in claim 16, wherein said integrated lever is adapted to rotate at a 90° angle of cam rotation providing an eccentricity that can deliver an inward thrust for purposes of translating the top plate over the base between open and closed positions.

18. The socket as claimed in claim 16, wherein said electronic package is a substrate supporting a microprocessor chip.

* * * * *